US008850752B1

(12) United States Patent
Graboski

(10) Patent No.: US 8,850,752 B1
(45) Date of Patent: Oct. 7, 2014

(54) HYBRID SEALED ATTIC INSULATION AND VENTILATION SYSTEM

(71) Applicant: Timothy Michael Graboski, Pompano Beach, FL (US)

(72) Inventor: Timothy Michael Graboski, Pompano Beach, FL (US)

( * ) Notice: Subject to any disclaimer, the term of this patent is extended or adjusted under 35 U.S.C. 154(b) by 0 days.

(21) Appl. No.: 14/066,809

(22) Filed: Oct. 30, 2013

Related U.S. Application Data

(60) Provisional application No. 61/752,129, filed on Jan. 14, 2013.

(51) Int. Cl.
*E04D 13/17* (2006.01)

(52) U.S. Cl.
CPC ..... *E04D 13/172* (2013.01)
USPC ..... 52/95; 52/302.3; 52/407.4; 52/745.2

(58) Field of Classification Search
CPC . E04D 13/1631; E04D 13/178; E04D 13/152; E04D 13/17; E04D 13/172; E04D 13/174; E04B 1/7654; E04B 2001/7691; E04B 1/64; E04B 1/70; E04B 1/7069; E04B 1/34336; E04F 1/1308
USPC ..... 52/94–95, 302.1, 404.1, 407.3–407.5, 52/404.2–404.3, 173.3, 90.1, 92.1–92.3, 52/506.04–506.06; 126/621; 454/365
See application file for complete search history.

(56) References Cited

U.S. PATENT DOCUMENTS

| | | | | |
|---|---|---|---|---|
| 2,318,820 | A * | 5/1943 | Voigt et al. | 52/302.3 |
| 4,934,338 | A * | 6/1990 | Hollick et al. | 126/622 |
| 6,797,356 | B2 * | 9/2004 | Zupon et al. | 428/131 |
| 7,094,145 | B2 | 8/2006 | Rye et al. | |
| 7,302,776 | B2 * | 12/2007 | Duncan et al. | 52/95 |
| D581,511 | S | 11/2008 | Rosten et al. | |
| 7,856,764 | B2 | 12/2010 | Kortuem et al. | |
| 7,861,467 | B2 | 1/2011 | Rosten et al. | |
| 8,347,562 | B2 * | 1/2013 | Morris et al. | 52/95 |
| 2008/0202041 | A1 * | 8/2008 | Dillon | 52/95 |
| 2009/0044797 | A1 * | 2/2009 | Klement | 126/621 |
| 2013/0074428 | A1 * | 3/2013 | Allen et al. | 52/173.3 |
| 2013/0247489 | A1 * | 9/2013 | Janesky | 52/302.1 |

FOREIGN PATENT DOCUMENTS

JP 2010037826 A * 2/2010

* cited by examiner

*Primary Examiner* — Jeanette E Chapman
(74) *Attorney, Agent, or Firm* — GableGotwals

(57) ABSTRACT

A sealed attic insulating and roof ventilating system has a receiver (lath) material attached to adjacent pairs of rafters and an insulation material secured to the lower surface of the receiver material. This arrangement creates an uninterrupted plenum between the receiver, rafters and roof decking through which air can circulate from the lower roof vents to the upper roof vents. The circulation of air through the plenum prevents moisture from accumulating or condensing under the roof decking and warping the decking, which ultimately leads to deterioration of the decking and failure of the roof covering. This air circulation also eliminates ice damming on the top surface of the roof covering.

13 Claims, 6 Drawing Sheets

HYBRID SEALED ATTIC INSULATION AND VENTILATION SYSTEM

CROSS-REFERENCE TO PENDING APPLICATIONS

This application claims priority to U.S. Prov. Pat. App. No. 61/752,129 filed, Jan. 14, 2013.

BACKGROUND OF THE INVENTION

The present invention relates generally to attic and under roof deck insulation systems. More particularly, the present invention relates to an attic insulation system that provides the benefits of both a conventional ventilated attic system and a sealed attic system.

To date, there are no effective means of preventing a spray polyurethane insulation or its equivalent from coming into contact with the underside of the roof decking or sheathing. There are ribbed baffle vents or panels made of vacuum molded polyvinyl chloride film which are installed between the rafters and the roof sheathing and provide a passage for air to flow from the building to the roof vent (see e.g. U.S. Pat. No. 7,861,467 B2; see also e.g. U.S. Pat. No. D581,511 S). Other types of ribbed baffles are placed between the rafters on the underside of the sheathing (see e.g. U.S. Pat. No. 7,856,764 B2; see also e.g. U.S. Pat. No. 7,094,145 B2).

None of the prior art panels creates an uninterrupted plenum or air barrier below the sheathing which spans the height of the rafters (thereby creating an air barrier), nor do they create a radiant barrier between the sheathing and panel. Additionally, none of the panels are intended to serve as a receiver (lath) material for a spray polyurethane insulation or its equivalent. And none of the panels are fire-rated or retardant. Last, the panels do not provide a monolithic assembly nor do they reinforce the building envelope.

SUMMARY OF THE INVENTION

An attic insulating system made according to this invention includes a receiver (lath) material, which is secured to adjacent pairs of roof rafters, and an insulation material, which is preferably a spray polyurethane insulation or its equivalent secured to the lower surface of the installed receiver material. The installed system creates an uninterrupted air barrier or plenum between the receiver material, roof rafters and decking through which air can circulate (ventilate) from the lower roof (soffit or intake) vents to the upper (exhaust) roof vents. The circulating air removes moisture and heat and helps prevent damage to the roof decking.

The receiver material may be a cloth, expanded metal, expanded plastic, geotextile, and the like material suitable for receiving the insulating material and may have an insulating material integrated into it. The receiver material is preferably semi-rigid and, prior to installation, stored in a roll. In a preferred embodiment, the receiver material is a geo-textile fabric fused with a polyester material reinforcement and having a weight of about 30 gsm. In another preferred embodiment, the receiver material is a sheet or panel having reinforced surface, which may be a wavy or corrugated lower face surface adhered to a liner board. An optional radiant barrier or reflective surface can be adhered to the upper face surface of the liner board.

ELEMENTS AND NUMBERING USED IN THE DRAWINGS AND DETAILED DESCRIPTION

Figure 1:
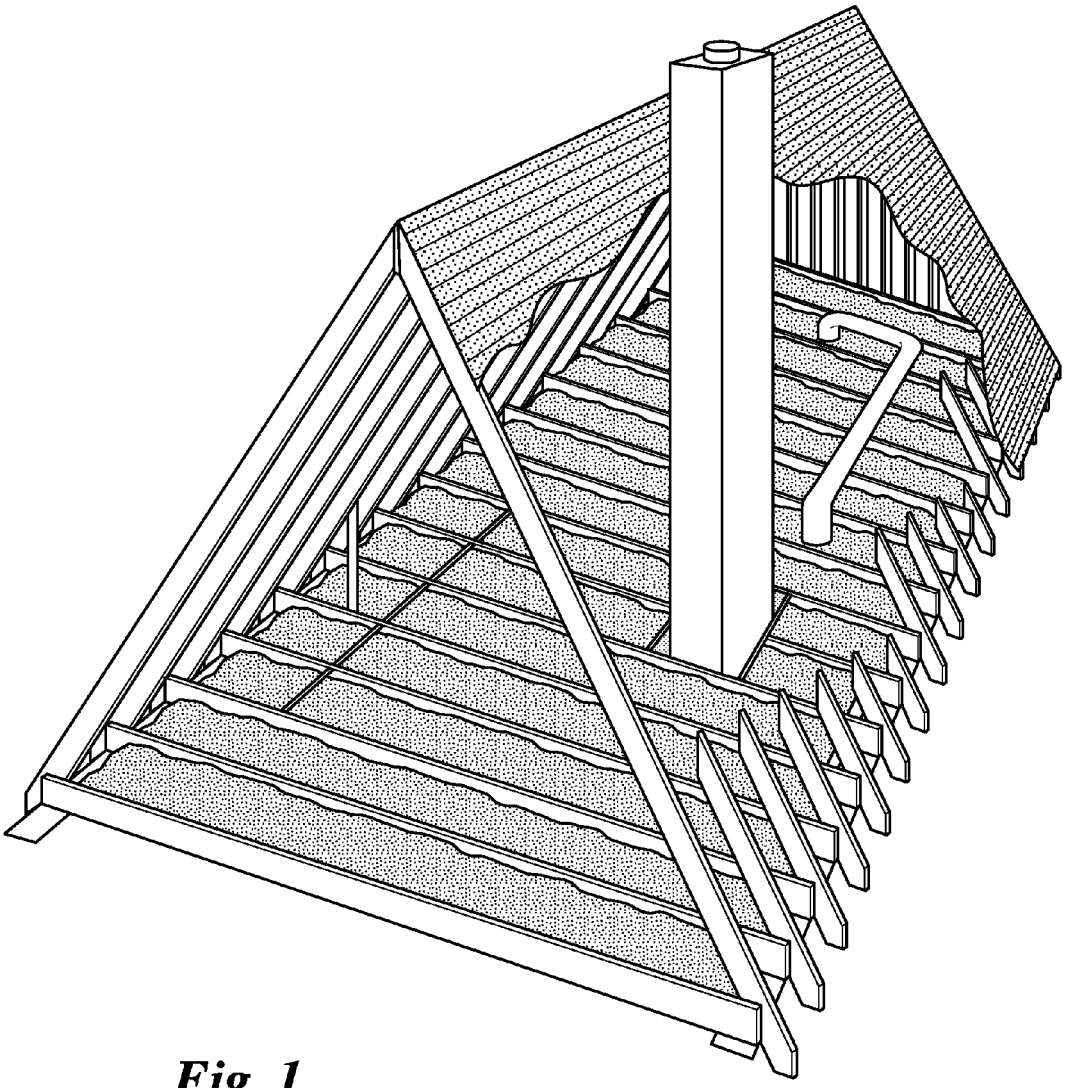
Fig. 1 ( PRIOR ART )
FIG. 1 is a perspective view of a prior art vented attic insulation system or conventionally insulated batt insulation system.
Figure 2:
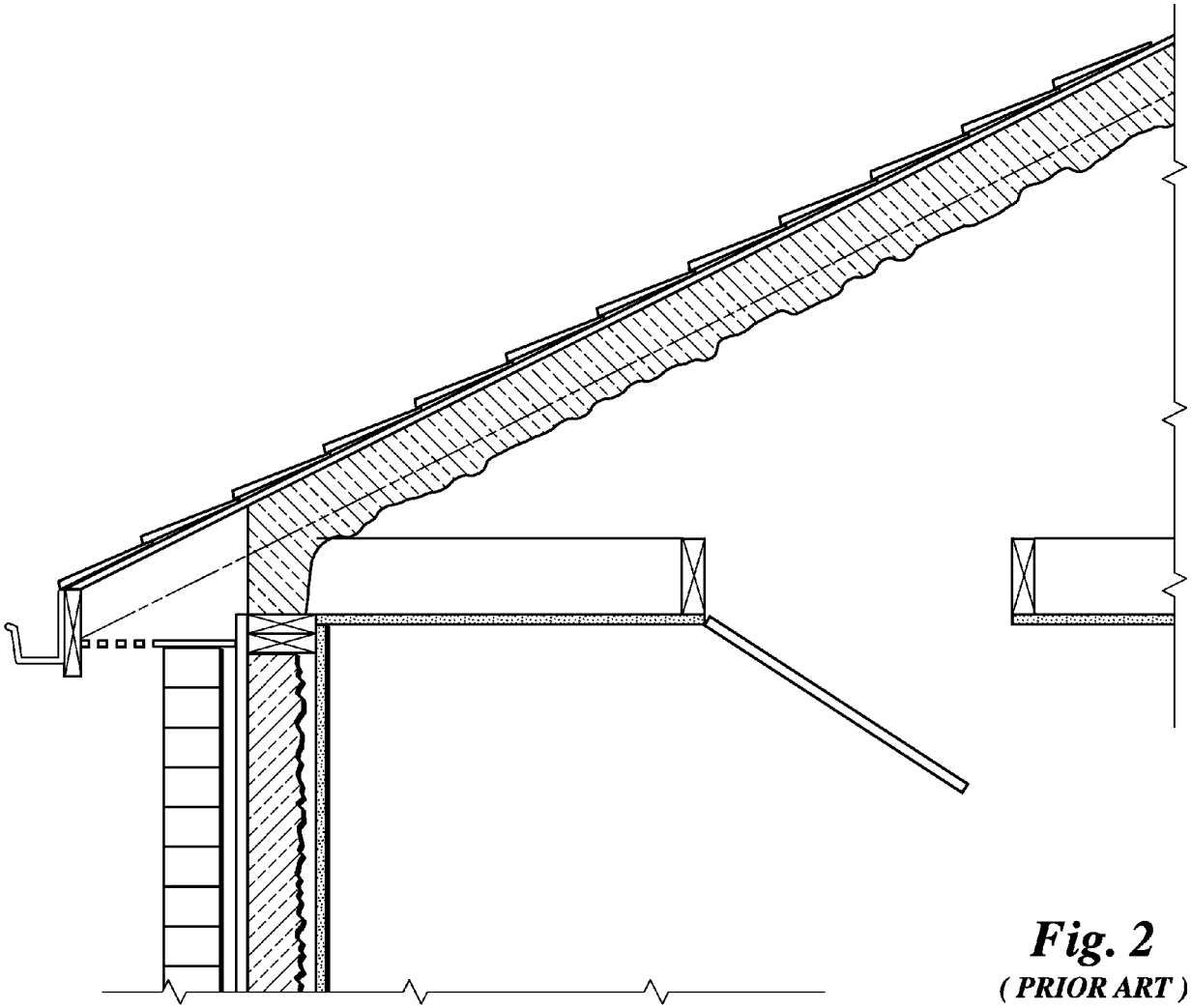
Fig. 2 ( PRIOR ART )
FIG. 2 is a cross section view of a prior art sealed attic insulation system.
Figure 3:
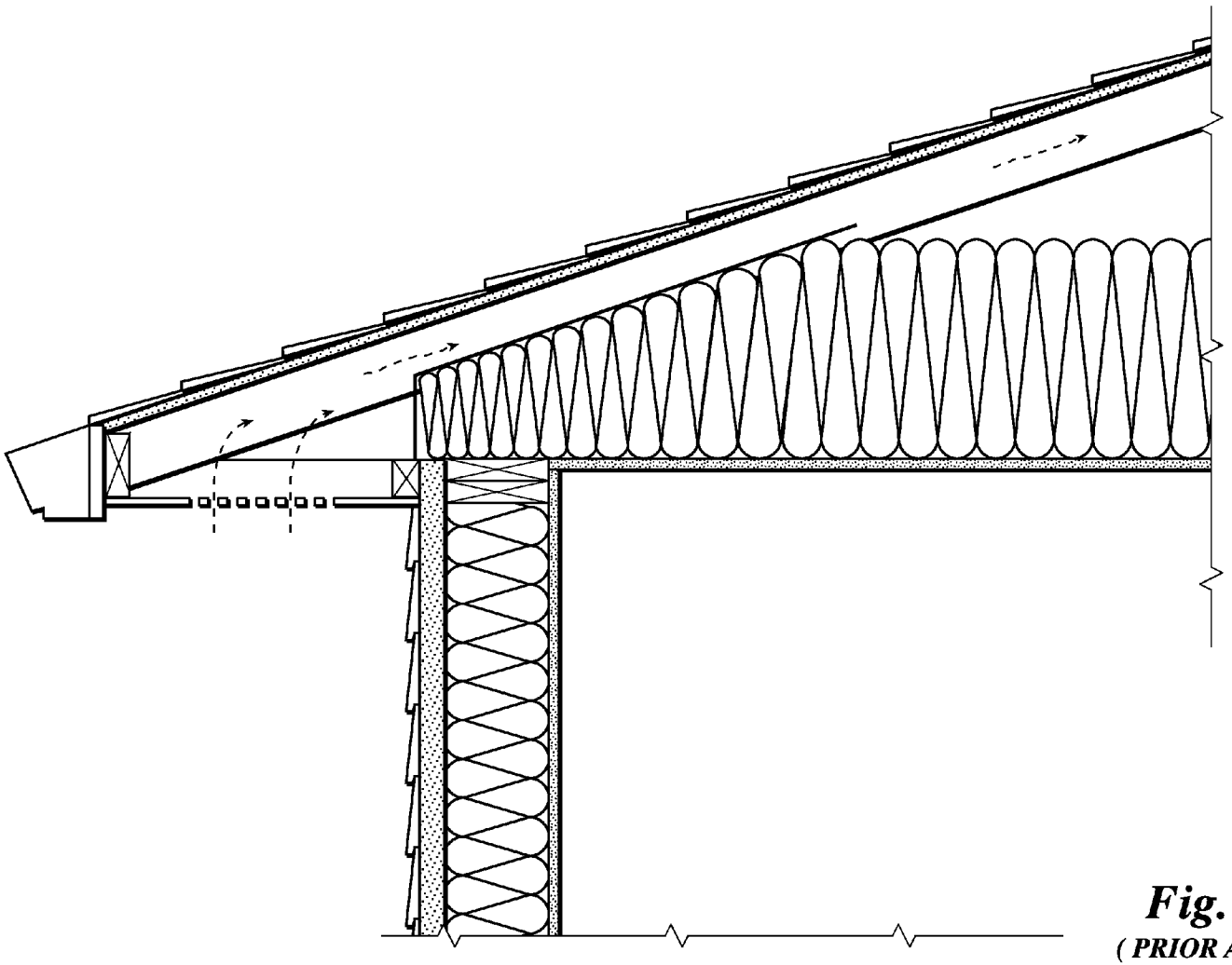
Fig. 3 ( PRIOR ART )
FIG. 3 is a cross section view of a prior art vented attic system.
Figure 4A:
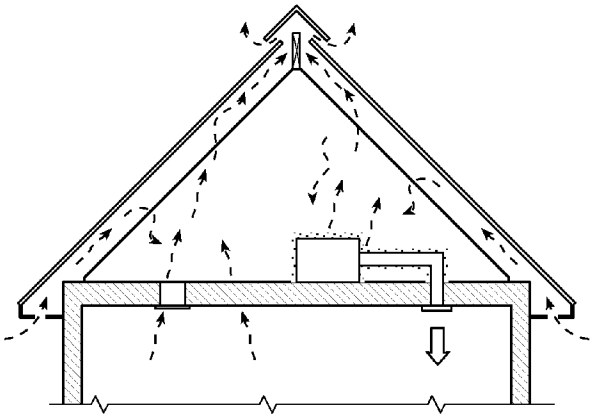
Fig. 4A ( PRIOR ART )
FIG. 4A is a schematic that shows the operation of a prior art vented attic in winter.
Figure 4B:
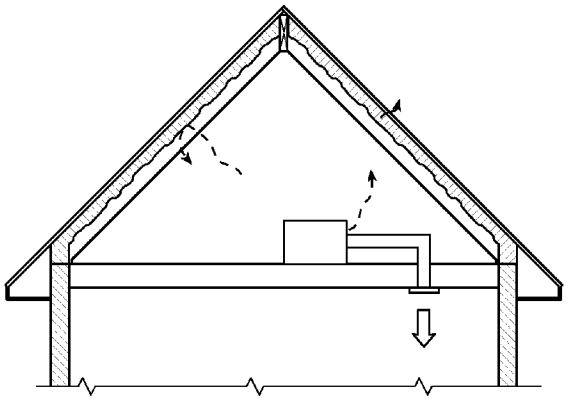
Fig. 4B ( PRIOR ART )
FIG. 4B is a schematic that shows the operation of a prior art sealed attic in winter.
Figure 4C:
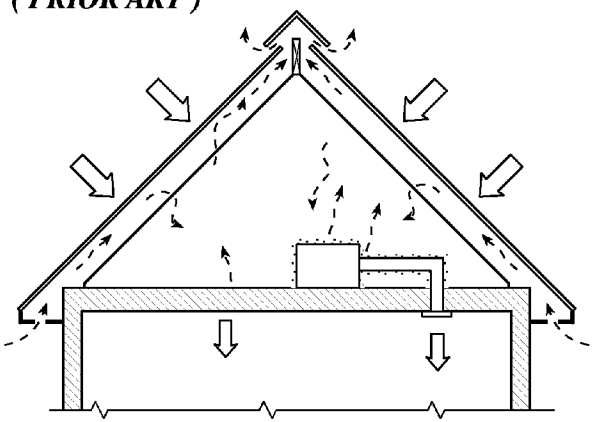
Fig. 4C ( PRIOR ART )
FIG. 4C is a schematic that shows the operation of a prior art vented attic in summer.
Figure 4D:
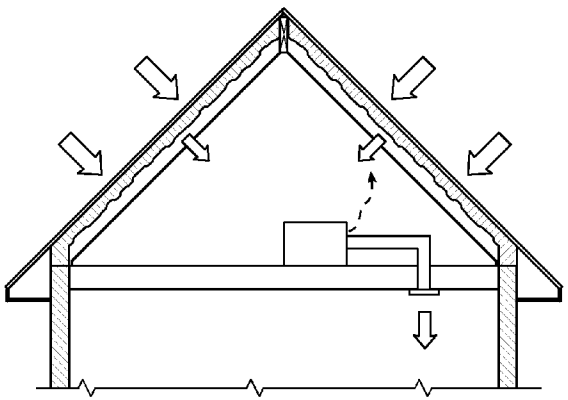
Fig. 4D ( PRIOR ART )
FIG. 4D is a schematic that shows the operation of a prior art sealed attic in summer.

10 Receiver (lath) material
12 Upper layer or surface of 10
14 Middle layer of 10
16 Lower layer or surface of 10
20 Hybrid sealed attic insulation and ventilation system
22 Attic space
24 Ceiling/floor joists
26 Roof rafters
28 Roof decking or sheathing
30 Bottom or inner side of 28
32 Roofing felt or underlayment
34 Weather-proof covering
38 Bottom side of 26
40 Insulating material
42 Air chamber (ventilation plenum)
43 Exhaust plenum
44 Lower vents or intake ventilators
46 Upper vents or exhaust ventilators
52 Interior space

DETAILED DESCRIPTION OF THE PREFERRED EMBODIMENTS

Figures 5, 8:
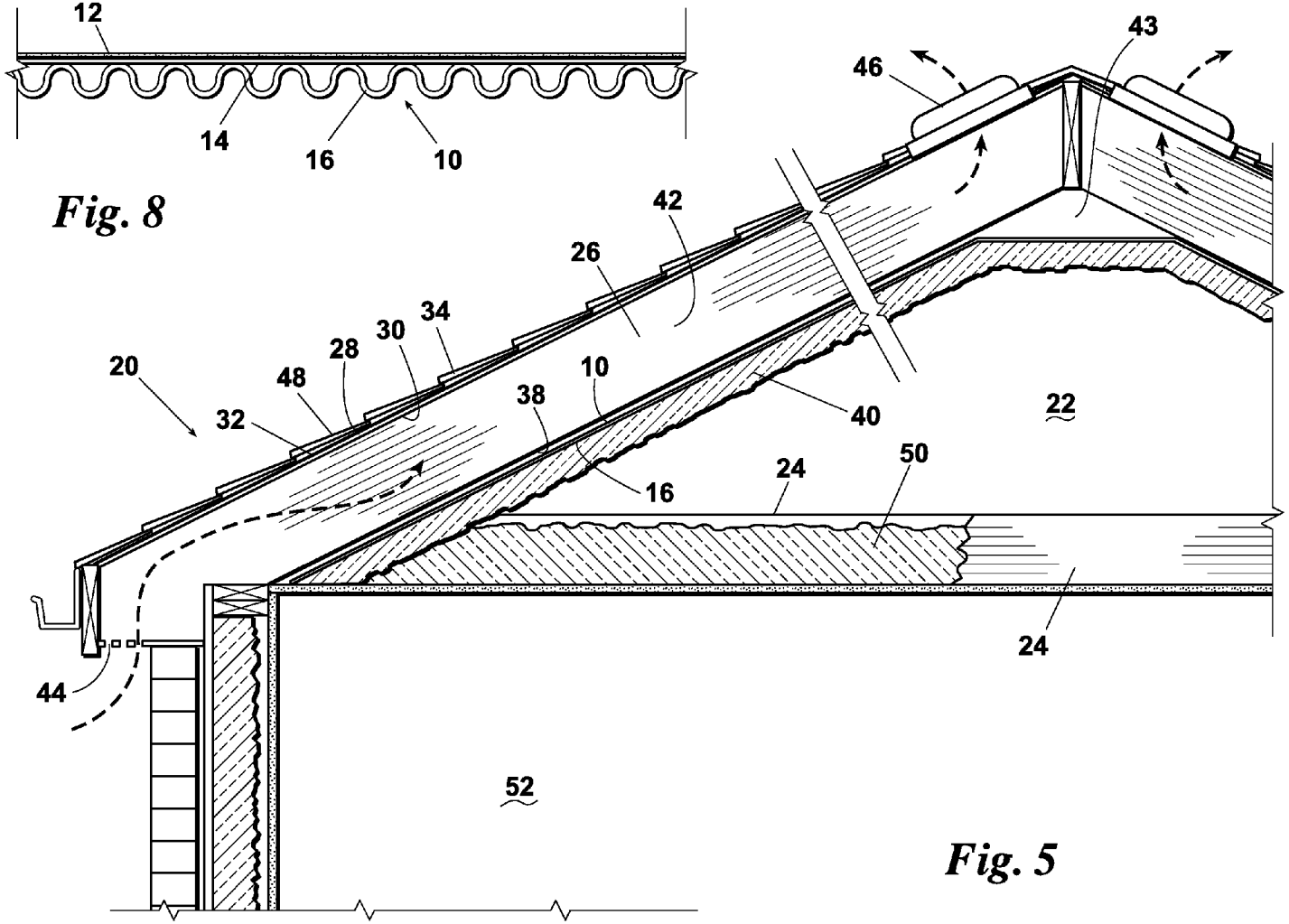
FIG. 5 is a cross section view of a preferred embodiment of an attic insulation and ventilation system of the present invention.
FIG. 8 is a cross-section view of another type of receiver (lath) material suitable for use in this invention.

Referring now to FIG. 5, a receiver (lath) material 10 is part of a system 20 used to insulate and ventilate an attic space 22 typically located between the ceiling/floor joists 24 of a building and the roof rafters (or top chords) 26. The roof rafters 26 support the roof decking 28 which, in turn, is typically overlaid with some type of weather-proof covering 34, such as composite shingles, tiles, metal, or the like. A roofing felt or underlayment 32 may also be located between covering 34 and the decking 28.

Receiver material 10 is attached to the bottom side 38 of the rafters 26 so that the upper layer or surface 12 is facing the bottom side 30 of roof decking 28 and the lower layer or surface 16 is facing away and toward the ceiling/floor joists 24. Preferably, receiver material 10 is sized to span the center-to-center distance of adjacent rafters 26.

The above arrangement provides an airspace or plenum 42 between the receiver material 10, rafters 26, and decking 28.

In a preferred embodiment, plenum 42 spans the distance between adjacent pairs of rafters 26, with the distance between the upper surface 12 of the receiver material 10 and the inner side 30 of the roof decking 28 being the height of the board used for the rafters 26 (or any height variation that allows for air flow for proper ventilation). An insulating material 40, such as but not limited to fiberglass insulation, spray polyurethane insulation or the like, is then applied to the lower surface 16.

Plenum 42 circulates air between the lower intake (soffit or eave) vents 44 and the upper (roof or exhaust) vents 46. The upper vents 46 may be any type of roof vent commonly used, including but not limited to ridge vents, wind driven turbines, solar powered ventilators, off ridge vents and electrically driven fan vents. The receiver material 10 can also be installed to create an exhaust plenum 43 toward the ridge portion (hips, ridge, transitional planes) of the roof.

The circulation of air through the plenum 42 prevents moisture from accumulating or condensing under the roof decking 28 and warping the decking 28, which ultimately leads to deterioration of the decking 28 and failure of the roof covering 34. This air circulation also eliminates ice damming on the top surface 48 of the roof covering 34. Ice damming can also lead to roof damage as well water infiltration to the roof and building structure.

The receiver material 10 and insulation material 40 can extend over the entire surface area defined by adjacent rafters 26 or a portion of that surface area. Once in place, the attic space 22 may be climate-controlled to make it more suitable for habitation or storage. In retrofit applications, it may be beneficial to remove existing batten insulation (not shown) between the ceiling/floor joists 28 to allow the climate-controlled air or heat from the interior space 52 below the attic space 22 to migrate into the attic space 22.

The receiver material 10 may be installed as a part of other systems in which an airspace or plenum 42 is desired between an external structure and the insulating material designed to prevent heat transfer between an interior insulated space and the structure.

The receiver material 10 can be any material which provides a surface for the insulation material 40 to adhere, including but not limited to cloth, expanded metal, expanded plastic, geotextile, and the like. Likewise, when spray insulation is used as insulation material 40, various materials can be used as the spray insulation. However, in the preferred embodiment, the spray insulation is a code approved spray polyurethane insulation (open cell, closed cell, or some combination of the two).

Figure 6:
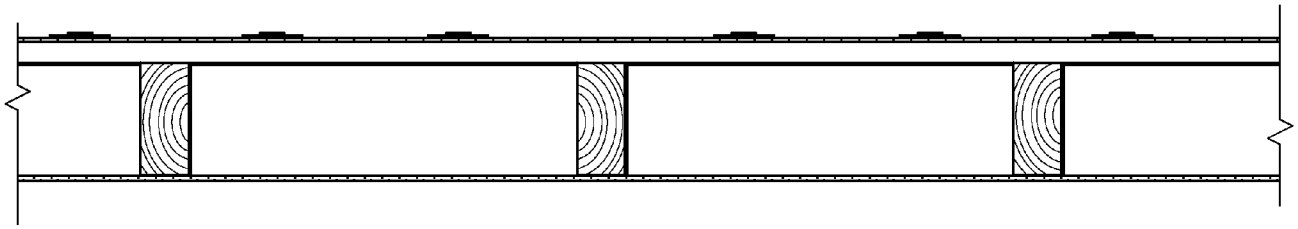
FIG. 6 is a cross-section view of a partial roof section having a preferred embodiment of a receiver (lath) material attached to its rafters.
Figure 7:
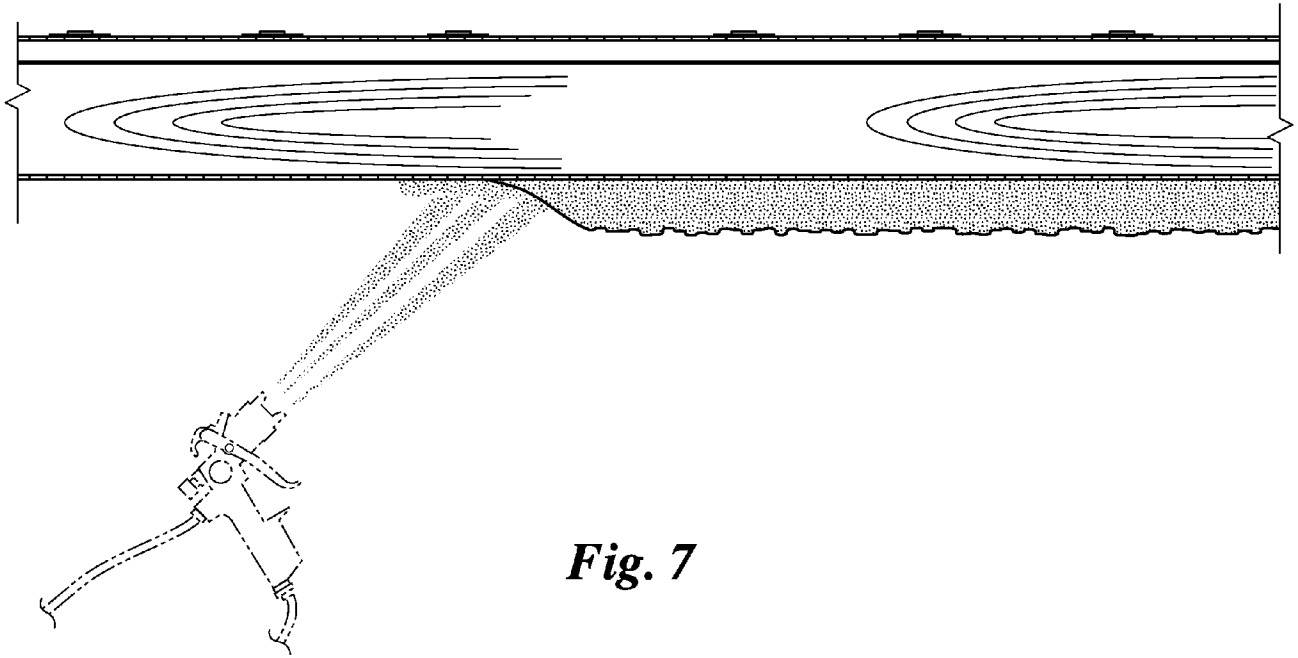
FIG. 7 is a cross-section view of the installed receiver material of FIG. 6 as spray-on insulation is being applied to the receiver material.

Referring now to FIGS. 6 and 7, receiver material 10 is a geo-textile fabric fused with a polyester material reinforcement and insulating material 40 is an spray insulation, preferably a code-approved spray polyurethane insulation. In this embodiment, receiver material 10 preferably has a weight of about 30 gsm. The polyester material reinforcement may be laminated on the top side of receiver material to form a water proof barrier. The geo-textile material can be a non-woven blue scrim which has the ability to integrate a foil (aluminum) to the material, thereby forming a reflective surface or radiant barrier.

Referring to FIG. 8, a receiver (lath) material 10 which is suitable for use in this invention is one being developed by Ridged Systems LLC (Delray Beach, Fla.) as a radiant barrier material that is waterproof and flame retardant. The receiver material 10 has an upper layer or surface 12 that is a reflective surface or radiant barrier and a lower surface or layer 16 that is a reinforced, corrugated (wavy) surface. Upper layer 12 is preferably a metalized film or, more preferably, an aluminum sheet having an emissivity rating 0.1 or less. Upper layer 12 is laminated to one side of middle layer 14 using a high heat-resistant adhesive. Preferably, the high heat-resistant adhesive is rated up to 325 degrees Fahrenheit.

Middle layer 14 is preferably fire retardant and water resistant. In a preferred embodiment, middle layer 14 is a natural kraft linerboard having a weight of at least 33 lbs/1000 sq-ft.

Lower layer 16 is preferably a corrugated medium of not less than 23 lbs/1000 sq-ft. Lower layer 16 is laminated to the other side of the middle layer 12 using a water-resistant, starch adhesive.

The preferred embodiments described above are not all possible embodiments of the invention. Therefore, the scope of the invention is defined by the following claims. Those claims cover elements which may not be specifically listed in the claims but represent trivial differences from, or are equivalent to, the specific elements listed in the claims.

What is claimed:

1. A sealed attic insulation and under roof decking ventilation system, the system comprising:

a receiver material having a flat uppermost face surface and a wavy lowermost face surface and sized to span at least one pair of adjacent rafters supporting a roof decking; and a polyurethane insulation material suitable for adhering to the wavy lowermost face surface of the receiver material;

the combination of the receiver material and the polyurethane insulation material when installed in a building structure creating a plenum between the flat uppermost face surface of the receiver material and an inward facing surface of the roof decking, the plenum extending between a soffit vent and a roof vent and permitting exterior air to circulate under the roof decking but preventing the exterior air from entering an interior space of the building structure located below the lower surface of the receiver material, the combination of the receiver material and the polyurethane insulation material when installed also preventing the exterior air from contacting the polyurethane insulation material.

2. A sealed attic insulation and under roof decking ventilation system, the system comprising:

a receiver material sized to span at least one pair of adjacent rafters supporting decking and consisting of three layers, namely, an uppermost radiant barrier layer, a fire retardant and water-resistant middle layer, and a lowermost insulation-receiving layer; and an insulation material suitable for adhering to the lower insulation-receiving layer;

the combination of the receiver material and the insulation material when installed in a building structure creating an air plenum located between the uppermost radiant barrier layer of the receiver material and inward facing surface of the roof decking, the air plenum permitting exterior air entering an intake vent of a roof system to circulate under the roof decking but preventing the exterior air from contacting the insulation material and entering an interior space of the building structure located below the plenum.

3. A system according to claim 2 wherein the insulation material is a fiberglass insulation material.

4. A system according to claim 2 wherein the receiver material prior to use in the system is stored in a roll.

5. A system according to claim 2 wherein the receiver material is a semi-rigid material.

6. A system according to 2 wherein the lowermost insulation-receiving layer is a corrugated layer.

7. A system according to claim 2 wherein at least one of the three layers includes a geo-textile fabric.

8. A system according to claim 7 wherein the geo-textile fabric is fused with a polyester material reinforcement.

9. A system according to claim 7 wherein the geo-textile fabric has a weight of about 30 gsm.

10. A system according to claim 1 wherein the flat uppermost face surface of the receiver material is a radiant barrier surface.

11. A system according to claim 2 wherein the receiver material is a rigid material.

12. A system according to claim 2 wherein the insulation material is a polyurethane insulation material.

13. A sealed attic insulation and under roof decking ventilation system, the system comprising:

a receiver material including a geo-textile fabric fused with a polyester reinforcement and sized to span at least one pair of adjacent rafters supporting a roof decking;

an insulation material suitable for attachment to a lowermost face surface of the receiver material;

the combination of the receiver material and the insulation material when installed in a building structure creating a plenum between an uppermost face surface of the receiver material and an inner face surface of the roof decking, the plenum extending between a soffit vent and a roof vent and permitting exterior air to circulate under the roof decking but preventing the exterior air from entering an interior space of the building structure located below the lower surface of the receiver material, the combination of the receiver material and the insulation material when installed also preventing the exterior air from contacting the insulation material.

* * * * *